US011903535B2

(12) United States Patent
Hirsch et al.

(10) Patent No.: US 11,903,535 B2
(45) Date of Patent: Feb. 20, 2024

(54) SAFETY INSERT FOR A CHILD'S WATER DEVICE

(71) Applicant: CREATING KLEES LLC, Chesterfield, MO (US)

(72) Inventors: Sarah Hirsch, Albany, NY (US); Katherine Greathouse, Wildwood, MO (US)

(73) Assignee: Creating Klees LLC, Chesterfield, MO (US)

( * ) Notice: Subject to any disclaimer, the term of this patent is extended or adjusted under 35 U.S.C. 154(b) by 0 days.

(21) Appl. No.: 17/587,392

(22) Filed: Jan. 28, 2022

(65) Prior Publication Data

US 2022/0240727 A1 Aug. 4, 2022

Related U.S. Application Data

(60) Provisional application No. 63/145,595, filed on Feb. 4, 2021.

(51) Int. Cl.

| | |
|---|---|
| ***A47K 3/00*** | (2006.01) |
| ***E04H 4/06*** | (2006.01) |
| ***A47K 3/024*** | (2006.01) |

(52) U.S. Cl.

CPC ..... *A47K 3/001* (2013.01); *A47K 3/024* (2013.01); *E04H 4/06* (2013.01)

(58) Field of Classification Search

CPC ..... A47K 3/001; A47K 1/06; A47K 3/024; E04H 4/06

See application file for complete search history.

(56) References Cited

U.S. PATENT DOCUMENTS 1,571,335 A * 2/1926 Jarvis ..... A47K 3/001 4/580
1,579,530 A * 4/1926 Heller ..... A47K 3/001 4/580
1,681,294 A * 8/1928 Henry ..... B65D 85/64 4/DIG. 18

(Continued)

FOREIGN PATENT DOCUMENTS

EP 2468160 A1 * 6/2012 ..... A47K 3/001

OTHER PUBLICATIONS

Comfysure Bath Cushion for Tub—Extra-Large Full Body Bath Tub Pillow & Non-Slip Spa Bathtub Mat Mattress Pad, https://www.amazon.com/ComfySure-Bath-Cushion-Tub-Extra-Large/dp/B0753972GG?ref_=fsclp_pl_dp_1, Accessed: Aug. 24, 2020, Amazon.com.

(Continued)

*Primary Examiner* — Erin Deery
(74) *Attorney, Agent, or Firm* — STERNE, KESSLER, GOLDSTEIN & FOX P.L.L.C.

(57) ABSTRACT

A flexible liner that is inserted onto bathtubs or children swimming pools to help cushion an impact and mitigate injury when a bather or swimmer falls on the hard ledges covered by the flexible liner. The device covers the ledges of the bathtub or pool with a soft, cushioning material and is attached to the bathtub or pool to maintain its position along dangerous, hard surfaces. The flexible liner has connectors where toys or other useful devices can be attached for the bather or swimmer to play with or utilize. The flexible liner is designed to add cushioning to decrease impact injury and entertain the bather or swimmer.

23 Claims, 3 Drawing Sheets

(56) References Cited

U.S. PATENT DOCUMENTS

| | | | | | |
|---|---|---|---|---|---|
| 2,264,672 | A | * | 12/1941 | Levine | A47K 3/001 D23/304 |
| 3,133,292 | A | * | 5/1964 | Spier | A47K 3/002 4/580 |
| 3,938,200 | A | * | 2/1976 | Roberts | A47K 3/001 160/368.1 |
| 4,051,563 | A | | 10/1977 | Clarke, Jr. | |
| 4,956,882 | A | | 9/1990 | Cohn, III | |
| 5,040,252 | A | | 8/1991 | Taggart | |
| 5,551,101 | A | * | 9/1996 | Leach | A47K 3/002 4/571.1 |
| 5,715,546 | A | | 2/1998 | Kvalvik | |
| 5,772,490 | A | * | 6/1998 | Leach | A47K 3/002 446/71 |
| 6,085,367 | A | | 7/2000 | Guiste | |
| 6,357,061 | B1 | | 3/2002 | Gonzalez | |
| 6,453,485 | B2 | * | 9/2002 | Bullock | A47K 3/002 4/DIG. 18 |
| 6,681,416 | B1 | | 1/2004 | Yang | |
| 6,896,155 | B1 | * | 5/2005 | Jones | A47K 3/38 383/41 |
| 7,152,256 | B1 | | 12/2006 | Roberts | |
| 10,413,132 | B2 | | 10/2019 | Cooper | |
| 2011/0231990 | A1 | | 9/2011 | Prather | |
| 2013/0061384 | A1 | * | 3/2013 | Robertson | E04H 4/14 4/496 |
| 2017/0196409 | A1 | | 7/2017 | Dillingham | |

OTHER PUBLICATIONS

Disney Inflatable Safety Bathtub Bumpers, Pixar Cars, https://www.walmart.com/ip/Disney-Inflatable-Safety-Bathtub-Bumpers-Pixar-Cars/194709487, Accessed Nov. 18, 2021, Walmart.com.

Splash n Bump The Bath Bumper Set (6 Months and above), https://www.amazon.co.uk/Splash-Bump-Bumper-Months-above/dp/B003604PNO, accessed Jan. 18, 2022, Amazon.com.

* cited by examiner

SAFETY INSERT FOR A CHILD'S WATER DEVICE

CROSS REFERENCE TO RELATED APPLICATIONS

This application is a non-provisional that claims benefit to U.S. Provisional Patent Application No. 63/145,595 entitled PADDED BATHTUB LINER AND METHOD THEREFOR, filed on Feb. 4, 2021, which is herein incorporated by reference in its entirety.

FIELD OF THE INVENTION

The present invention relates to pool and bathtub cushioning liners and more particularly pertains to a new liner designed to reduce injuries and create an interactive environment for children in the pool or bathtub. Toddler and infant injuries can be reduced or eliminated by proper use of the invention.

BACKGROUND

The bathroom is one of the most common places for accidents to occur in the home. The combination of slippery surfaces with water or lubricated fluid creates an area where bathers easily lose traction, slip, and injure themselves. Bathing areas are overwhelmingly hard, smooth surfaces which can facilitate not only the loss of traction but also injuries upon impact. To help increase traction and prevent slipping, bathtub mats are often installed in the floor of the bathtub. These mats are often temporarily affixed to the floor of the bathtub. While increasing traction, the mats are not fall proof and do not cushion the hard ledges along a bathtub when a bather slips and falls.

The hard ledges of the bathtub are dangerous when a bather slips. Additionally, many bathing areas have ledges down the side of the bathtub that provide an area to store soap, shampoo, and other bathing devices. This otherwise useful area becomes a danger to those who slip in the bathtub.

Toddlers are at an even greater risk of slipping because of their lack of understanding for the potential danger, along with the antics that come with being a toddler. Playing, jumping, and protesting is commonplace. The bathtub environment is no different and when toddlers are bathing, safety becomes especially important because of the risk of slipping and injuring themselves. Additionally, there are pools for children (Kiddie Pools) that also have hard ledges that can create the opportunity for injury when a child slips and falls.

What is needed is a device to increase toddler safety around the hard surfaces of a bathing or swimming area where a toddler can slip, fall, and injure themselves.

SUMMARY OF THE INVENTION

Toddler safety can be improved according to certain illustrative aspects of the invention as described herein in connection with the following description and drawings. In some aspects the invention makes bathing toddlers safer and more engaging for the bather. In an embodiment, the invention is a bathtub insert that lines the hard and dangerous edges of the bathtub in a cushioning, soft material. The purpose being, when a toddler slips and falls in the bathtub, this insert will cushion the impact and prevent or otherwise limit the injury. It is temporarily affixed to the bathtub, but can be left on for extended periods of time. To increase engagement for toddlers in the bath, entertainment devices for the child to interact with are positioned along the top portion of the liner of the insert. When a toddler is bathing, there will be devices to make bathing fun. This could range from basketball hoops to alphabetic lettering to water funnels.

In one aspect of the invention the insert comprises a flexible liner which is fastened to the bathtub. The ledge portion of the flexible liner can be fastened to the hard ledge of the bathtub. A skirt can extend from the ledge portion into the bathtub, cushioning the hard sides of the bathtub but also cushioning the bather from any protrusions that may exist on the sides of the bathtub. Fasteners can be disposed between the liner and the bathtub, for securing the liner the bathtub. Along the upper outer perimeter of the skirt are one or more connectors that are configured to support one or more bath attachments. These attachments can create an interactive experience for the bather or can serve a utility, such as a holding receptacle.

In some embodiments, there are sides of the ledge portion that extend beyond the hard ledge of the bathtub. These sides can be fastened to the wall of the bathing area or can be disposed down the outer side of the bathtub, and possibly fastened to the outer side of the bathtub. For example, if the entry point into the bathtub has a ledge and the opposite side has a vertical wall, sides of the ledge portion can be fastened to both the entry ledge and the vertical wall. Where sides of the ledge portion meet can be slits in the flexible liner. The slits separate the ledge portion extensions from one another, allowing the liner to conform to the corners of the surrounding wall.

In some embodiments, the flexible liner can further cushion impacts with an attached outer jacket. The outer jacket can be made of flexible waterproof or water-resistant material and configured to be placed on the outer surface of the flexible liner. In some embodiments, the outer jacket is formed of water-resistant padded material. In still other embodiments, this material comprises one of the following: polyurethane laminate (PUL), thermoplastic polyurethane (TPU), waxed cotton, nylon, polyester, or similar materials. In some embodiments, the outer jacket comprises at least one cushion member configured to be secured to the upper outer surface of the ledge portion to provide additional protection to bathers. This cushion member can be made water-tight to prevent moisture from entering the cushion member. Alternatively, the cushion member can be made from a fill material to obtain a desired softness.

The bath attachments can be different items, serving different purposes. For example, in some embodiments an attachment can be a holding receptacle. This can be used as a storage for bathing supplies. However, in other embodiments one of the bath attachments can be a hoop with an attached net, such as a miniature basketball hoop. In other embodiments, one of the bath attachments can a funnel for use with a pail or water squiring toys. In still other embodiments, the bath attachment can be a plurality of alphabetic lettering.

In a preferred embodiment, the connectors are a snap fastener, also called a press stud, dome fastener, popper, snap, or tich. However, in other embodiments the connectors include a hook configured to engage a corresponding retention feature of the one or more bath attachments. For example, the hook can be configured to engage a draw string or metal circlet on a meshed bag bath attachment. In some embodiments, the connectors include a hook and loop system to support the bath attachments.

In some embodiments, the insert can comprise a decorative theme. This theme can then be matched by corresponding bath attachments. For example, in an aquatic theme, the bath attachments can be mermaid style netting, water-squirting fish toys, and/or fishing poles. In another example, a pirate theme can be matched by sunken treasure styled bath attachments. These examples are merely illustrative and should not be seen as limiting.

In a preferred embodiment, the fasteners that attach the liner to the bathtub can be suction cups.

In some embodiments, the ledge portion of the liner is constructed to fit round, oval, and substantially circular surfaces. In other embodiments, the ledge portion is constructed to fit a square or rectangular surface.

In another aspect of the invention, the insert is for a small pool for children. This pool insert can include a ledge portion which is disposed to the top edge of the pool. A skirt extends down from this ledge portion. The pool insert is secured to the pool by a plurality of fasteners, such as suction cups. In other embodiments, the fasteners can be a hook and loop system. In some embodiments, there can be one or more connectors that are secured along an upper outer perimeter of the skirt configured to support one or more pool attachments. The insert can have a length that corresponds to a perimeter of the pool, and the insert can form a continuous loop (such that there is no seam).

These aspects are indicative of various ways in which the subject matter can be practiced, all of which are intended to be within the scope of the claimed subject matter. Other advantages and novel features can become apparent from the following detailed description when considered in conjunction with the drawings.

These and other features will be more particularly described by the following descriptions of the drawings and certain preferred embodiments.

SUMMARY OF THE FIGURES

The systems, devices and methods can be better understood by referring to the following description in conjunction with the accompanying drawings, in which like numerals indicate like structural elements and features in various figures. The components in the figures are not necessarily to scale, and simply illustrate the principles of the systems, devices and methods. The accompanying drawings illustrate only possible embodiments of the systems, devices and methods and are therefore not to be considered limiting in scope.

DETAILED DESCRIPTION

Aspects of the system are described below with reference to illustrative embodiments. The references to illustrative embodiments below are not made to limit the scope of the claimed subject matter. Instead, illustrative embodiments are used to aid in the description of various aspects of the systems. The description, made by way of example and reference to illustrative reference is not meant to be limiting as regards any aspect of the claimed subject matter.

Figure 1:
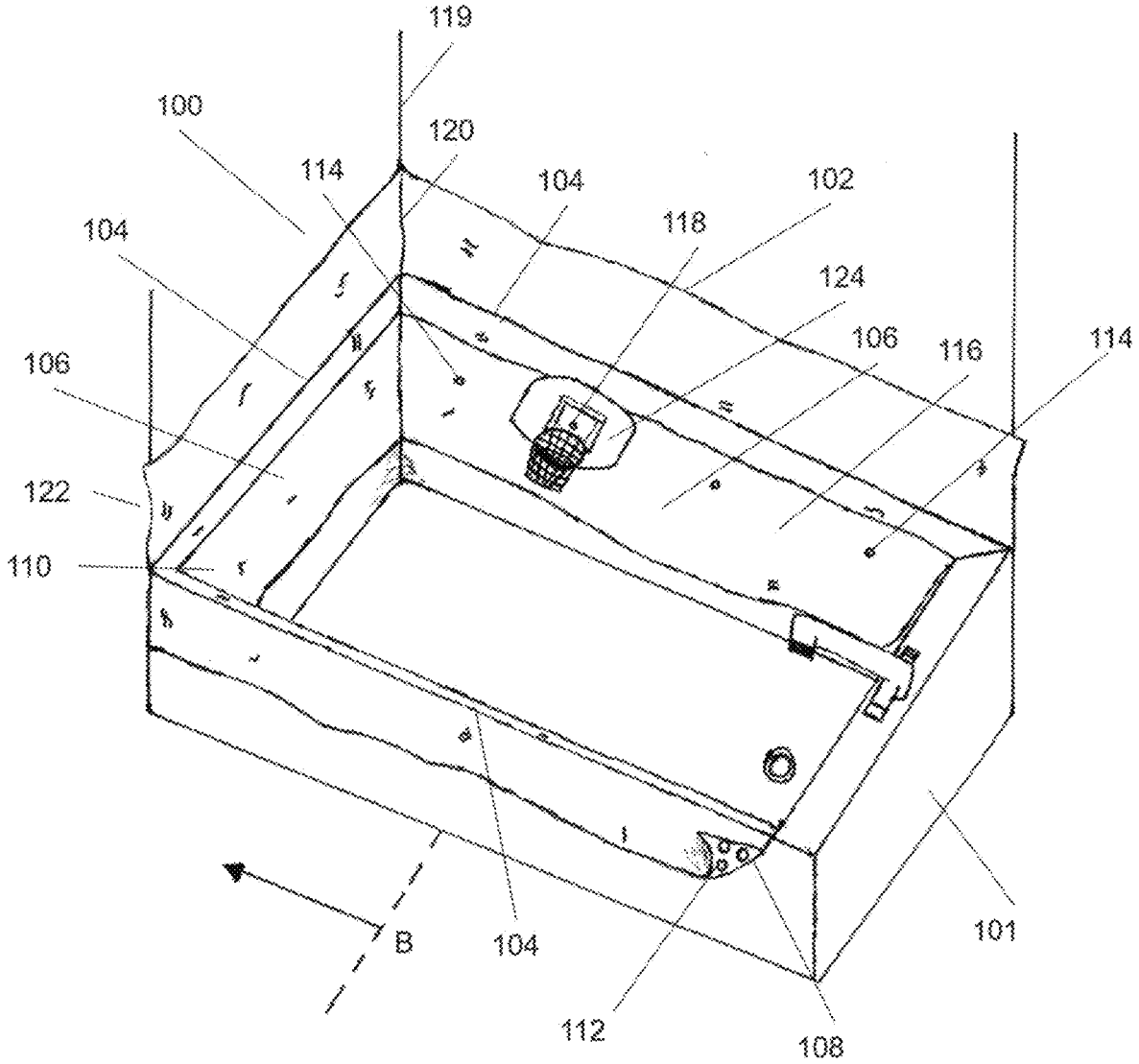
FIG. 1 is an isometric view illustrating an embodiment of the insert on a bathtub.

FIG. 1 is an isometric view illustrating an embodiment of the insert on a bathtub. Referring now to FIG. 1, an embodiment illustrating a bathtub insert 100 mounted to a bathtub 101 is shown. The bathtub insert can 100 cover the ledges of the bathtub 101. The ledges of the bathtub can be covered by the ledge portion 104 of the flexible liner 102. In some embodiments the ledge portion 104 can be constructed to fit one or more of the following surfaces: round, oval, and substantially circular surfaces. In other embodiments, the ledge portion 104 is constructed to fit a square or rectangular surface.

The skirt 106 can extend down edges of the bathtub 101 to cushion the sides of the bathtub and to cushion any protrusions that can extend out a side of the bathtub 101. While not illustrated, these protrusions are commonly found on baths as places to store soap, shampoo, or other bathing devices. In a preferred embodiment the flexible liner 102 attaches to only three sides of the bathtub 100, although in other embodiments it can attach to all four sides. Preferably, the faucet side is not covered, as illustrated in FIG. 1. Additionally, the flexible liner 102 need not cover the bottom of the bathtub 100.

In some embodiments, the edges of the flexible liner 102 affixed to the bathtub wall have a first slit 120 and second slit 122 to allow separation between the two sides of the flexible liner 102. This creates a smoother attachment to the wall at the wall corner 119. In addition, the slits prevent undesirable creasing at the edges.

The inner surface of the liner 108 is disposed between the bathtub 101 and the bathtub insert 100. The outer surface of the liner 110 is disposed between the bathtub insert 100 and the bather. The inner surface of the liner 108 and the outer surface of the liner 110 define two sides of the flexible liner 102. A plurality of fasteners 112 can be disposed on the inner surface of the liner 108 to secure the flexible liner 102 to the bathtub 101. In the illustrated embodiment, the fasteners 112 are a plurality of suction cups. However, other fasteners 112 can be used without departing from the spirit and scope of the present invention, such as a hook and loop system, adhesives, or a hook hanging system.

Located along the upper outer perimeter of the skirt 116 is at least one connector 114 which is permanently secured to the flexible liner 102 and configured to support one or more bath attachments 118. In a preferred embodiment, the connector 114 is a snap fastener, also called a press stud, dome fastener, popper, snap, or tich. In other embodiments the connector 114 can be a hook configured to engage a corresponding retention feature of the one or more bath attachments 118. In still other embodiments the connector 114 can be a hook and loop system.

The bath attachments 118 can create a stimulating engagement with the bather for entertainment during bath time. The bath attachments 118 can be interchangeable or they can be permanently affixed. These can create a fun and interactive bath experience for bathing toddlers. The bath attachments can include, but are not limited to, a miniature basketball hoop 124, water squirt guns, a funnel 304, a plurality of alphabetic lettering 306, and meshed bags or other holding receptacles to store bath time supplies and play things. For example, a mesh bag can be used to store cleaning products while bathing, toys to entertain the bather or similar items. The meshing of the mesh bag can allow wet items placed in the interior of the mesh bag to drain and air dry.

While not illustrated, the flexible liner 102 can be designed with different themes. For example, an aquatic or underwater theme. In those embodiments, the flexible liner 102 can contain imagery depicting an underwater adventure to generate feelings of fun and to be immersive for the bather. The bath attachments 118 can be created to be coordinated with the varying themes. In an aquatic theme, the bath attachments 118 can be configured to include fish, mermaid nets, a fish squirting toy, miniature fishing poles and the like. While themes can be supported in different embodiments, themes are optional are should not be seen in a limiting manner. Other themes can be used without departing from the spirit and scope of the present invention.

Figure 2:
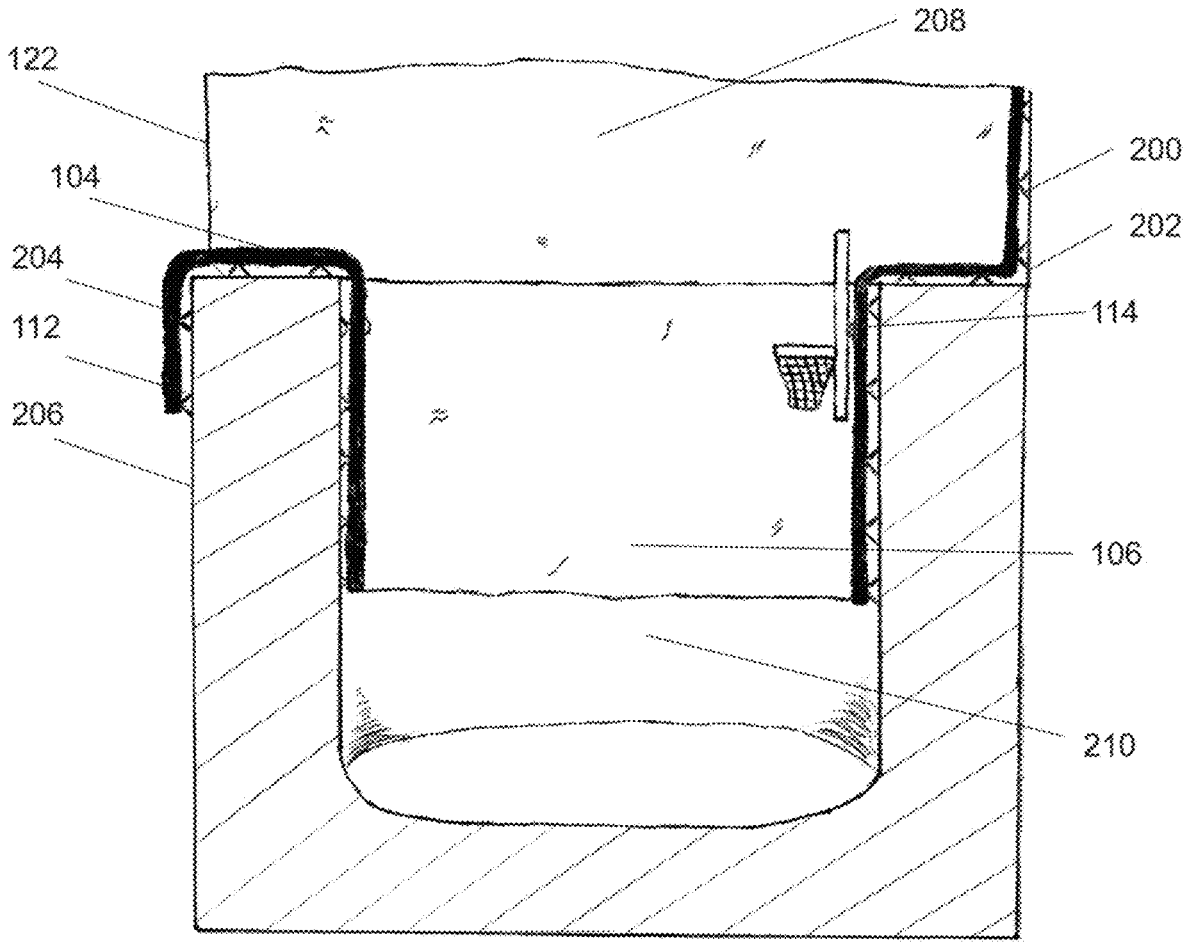
FIG. 2 is a cross-sectional view from section line B of FIG. 1 of the bathtub and insert.

Referring now to FIG. 2, FIG. 2 is a cross-sectional view of the embodiment in FIG. 1 from section line B. The fasteners 112 can be suction cups, which is one system of fastening the flexible liner 102 to the bathtub 101. Other systems can include a hook and loop system, adhesives, or a hook hanging system. A first side portion 200 of the ledge portion 104 is configured to be disposed along the first side of the bathtub 202. A second side portion 204 of the ledge portion 104 is configured to be disposed along the second side of the bathtub 206. A back side portion 208 of the ledge portion 104 is configured to be disposed along the back side of the bathtub 210. A front side of the bathtub is shown as the faucet-side, where water would enter and fill the bathtub 101.

The first side of the bathtub 202 is illustrated as a vertical wall. The second side of the bathtub 206 is illustrated as the entry point into the bathtub 101. The first side portion 200 and the second side portion 204 can be configured to affix to both a vertical wall and the entry point into the bathtub 101. This serves as additional cushioning against the walls and entry point but also helps prevent movement of the flexible liner 102 once the fasteners 112 are attached.

The first slit 120 is disposed between the first side portion 200 of the ledge portion 104 and the back side portion 208 of the ledge portion 104. The second slit 122 is disposed between the second side portion 204 of the ledge portion 104 and back side portion 208 of the ledge portion 104. The first slit 120 and second slit 122 permit the flexible liner 102 to smoothly conform to the shape of the bathtub 101 or surrounding structure, near where the first side of the bathtub 204 and the second side of the bathtub 206 meet the back side of the bathtub 210.

Figure 3:
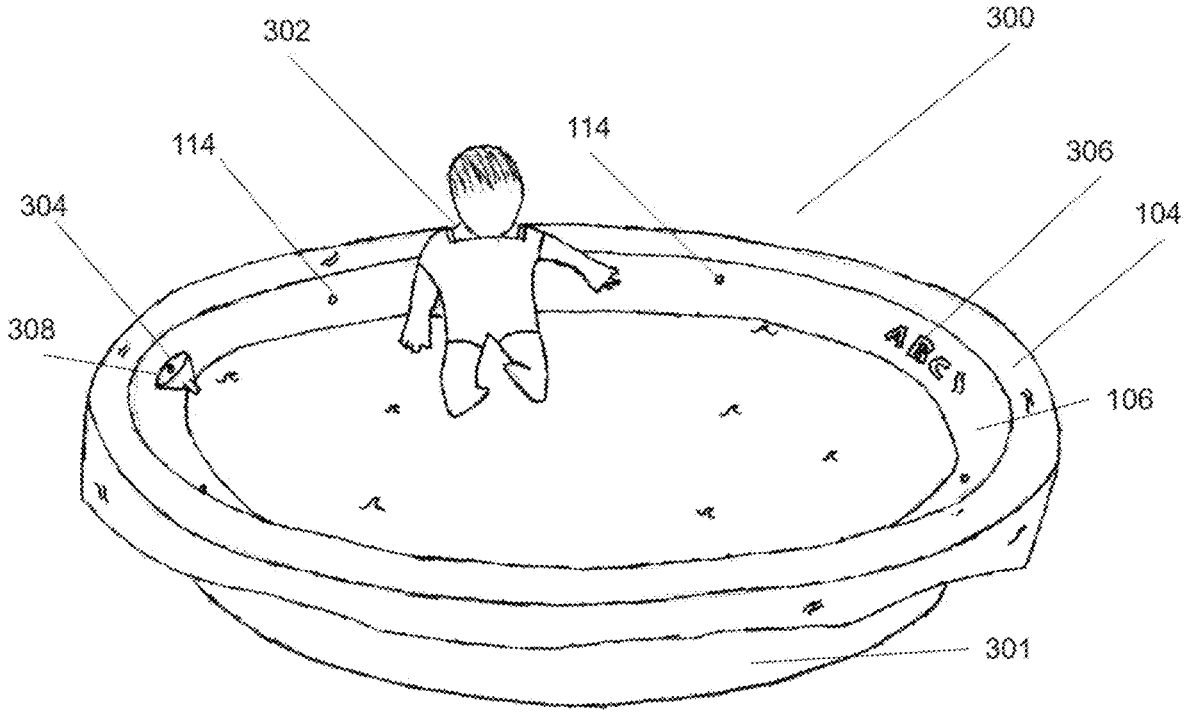
FIG. 3 is an isometric view illustrating an embodiment of the invention that can be used in a swimming pool for children.

Referring now to FIG. 3, FIG. 3 is an isometric view illustrating an embodiment of the invention to be used in a swimming pool for children. The pool insert 300 comprises a flexible liner 102 that surrounds the edges of the pool 301 and cushions the otherwise hard edges of the pool 301 to protect the children. In the illustrated embodiment, the ledge portion 104 drapes downward over the edge of the pool 301. Similar to the bathtub embodiment, the ledge portion 104 can be attached to the outside of the pool 301 by a plurality of fasteners 112 or left unattached, as shown. A plurality of fasteners 112 are configured to be disposed between the inner surface of the liner 108 and the pool 301.

Along the upper outer perimeter of the skirt 116 are connectors 114. In the illustrated embodiment, a funnel 304 and alphabetic lettering 306 is shown. The alphabetic lettering 306 can be used for fun or as a learning device for the swimmer 302. While only three letters, A, B, and C, are shown, it is understood that any letter or plurality of letters can be attached to connectors 114. The connectors 114 are configured to support one or more pool attachments 308, such as, but not limited to, a miniature basketball hoop 124, water squirt guns, a funnel 304, a plurality of alphabetic lettering 306, and meshed bags or other holding receptacles to store pool time supplies. The purpose of these pool attachments 308 is to create a fun and interactive swimming experience. Consistent with the bathtub embodiment, preferably the embodiments for children's swimming pools do not extend to completely cover the bottom of the pool 301. In some embodiments the pool insert 300 is of a length that corresponds to the perimeter of the pool, such that the flexible liner 102 forms a continuous shape corresponding to the perimeter. Embodiments include the continuous shape forming a contiguous loop such that there is no vertical seam.

What has been described above includes examples of aspects of the claimed subject matter. It is, of course, not possible to describe every conceivable combination of components or methodologies for purposes of describing the claimed subject matter, but one of ordinary skill in the art can recognize that many further combinations and permutations of the disclosed subject matter are possible. Accordingly, the disclosed subject matter is intended to embrace all such alterations, modifications and variations that fall within the spirit and scope of the appended claims. Furthermore, to the extent that the terms "includes," "has" or "having" or variations in form thereof are used in either the detailed description or the claims, such terms are intended to be inclusive in a manner similar to the term "comprising" as "comprising" is interpreted when employed as a transitional word in a claim.

What is claimed is:

1. A bathtub insert for mounting in a bathtub, the insert comprising:

a flexible liner comprising:

ledge portions for positioning on top edges, respectively, of the bathtub having a plurality of side walls;

skirt portions extending down respectively from the respective ledge portions on inner surfaces, respectively, of the plurality of side walls;

an inner surface of the flexible liner disposed between the flexible liner and the bathtub; and an outer surface of the flexible liner opposite the inner surface of the flexible liner; and one or more fasteners disposed between the inner surface of the flexible liner and the bathtub for securing the flexible liner to the bathtub, wherein each skirt portion has a length shorter than that of each side wall of the bathtub such that an inner bottom surface of the bathtub is fully exposed.

2. The bathtub insert of claim 1, wherein the flexible liner further comprises, on outer surfaces of the plurality of side walls:

a first side portion configured to be disposed along a first side of the bathtub;

a second side portion configured to be disposed along a second side of the bathtub;

a back side portion configured to be disposed along a back side of the bathtub, wherein the back side of the bathtub is opposite to a front side of the bathtub, the front side having a faucet or entry point for water;

a first slit disposed between the first side portion and the back side portion; and a second slit disposed between the second side portion and the back side portion, the first and second slits permitting the flexible liner to conform to the shape of the bathtub, wherein the first and second sides the bathtub meet the back side of the bathtub.

3. The bathtub insert of claim 1, wherein the flexible liner further comprises an outer jacket for additional cushioning, the outer jacket being made of a flexible waterproof or water-resistant material and configured for placement on the outer surface of the flexible liner.

4. The bathtub insert of claim 3, wherein the outer jacket is formed of a water-resistant padded material.

5. The bathtub insert of claim 4, wherein the water-resistant padded material comprises at least one of: Polyurethane Laminate, Thermoplastic Polyurethane, waxed cotton, nylon, or polyester.

6. The bathtub insert of claim 3, wherein the outer jacket further comprises at least one cushion member configured to be secured to an upper outer surface of a ledge portion to provide additional protection.

7. The bathtub insert of claim 6, wherein the at least one cushion member comprises a water-tight seal to prevent moisture from entering the at least one cushion member.

8. The bathtub insert of claim 6, wherein the at least one cushion member comprises a fill material to obtain a desired softness.

9. The bathtub insert of claim 1, further comprising one or more connectors secured along a skirt portion on the outer surface of the flexible liner, wherein the one or more connectors are configured to support one or more bath attachments, and wherein at least one of the one or more bath attachments comprises a holding receptacle.

10. The bathtub insert of claim 1, further comprising one or more connectors secured along a skirt portion on the outer surface of the flexible liner, wherein the one or more connectors are configured to support one or more bath attachments, and wherein at least one of the one or more connectors includes a hook configured to engage a corresponding retention feature of the one or more bath attachments.

11. The bathtub insert of claim 1, further comprising one or more connectors secured along a skirt portion on the outer surface of the flexible liner, wherein the one or more connectors are configured to support one or more bath attachments, and wherein at least one of the one or more connectors includes a snap fastener to engage a corresponding snap on the one or more bath attachments.

12. The bathtub insert of claim 1, further comprising one or more connectors secured along a skirt portion on the outer surface of the flexible liner, wherein at least one of the one or more connectors includes a hook and loop system.

13. The bathtub insert of claim 1, further comprising one or more connectors secured along a skirt portion on the outer surface of the flexible liner, wherein the one or more connectors are configured to support one or more bath attachments, and wherein at least one of the one or more bath attachments comprises at least one of a hoop with an attached net, a funnel for use with a pail or water squirting toys, or an Alphabetic lettering.

14. The bathtub insert of claim 1, further comprising a decorative theme.

15. The bathtub insert of claim 14, further comprising one or more connectors secured along a skirt portion on the outer surface of the flexible liner, wherein the one or more connectors are configured to support one or more bath attachments, and wherein the one or more bath attachments correspond to the decorative theme.

16. The bathtub insert of claim 1, wherein the one or more fasteners comprise a suction cup.

17. The bathtub insert of claim 1, wherein the ledge portions are configured to fit a curved surface.

18. The bathtub insert of claim 1, wherein the ledge portions are constructed to fit at least one of a square or rectangle surface.

19. The bathtub insert of claim 1, wherein the skirt portions are configured to cover protrusions on inner surfaces of the plurality of side walls, and wherein the inner surfaces of the plurality of side walls of the bathtub are partially exposed.

20. The bathtub insert of claim 1, wherein the insert further comprises one or more connectors secured along a skirt portion on the outer surface of the flexible liner, wherein the one or more connectors are configured to support one or more bath attachments.

21. A pool insert for mounting in a pool, the insert comprising:

a flexible liner comprising:

a ledge portion for positioning on a top edge of the pool;

a skirt portion extending down from the ledge portion;

an inner surface of the flexible liner disposed between the flexible liner and the pool; and an outer surface of the flexible liner opposite the inner surface; and one or more fasteners disposed between the inner surface of the flexible liner and the pool for securing the flexible liner to the pool, wherein the skirt portion has a length shorter than that of each side wall of the pool such that an inner bottom surface of the pool is fully exposed.

22. The pool insert of claim 21, wherein the flexible liner has a length that corresponds to a perimeter of the pool, such that the flexible liner forms a continuous shape corresponding to the perimeter of the pool.

23. The bathtub insert of claim 21, wherein the insert further comprises one or more connectors secured along an upper outer perimeter of the skirt portion of the flexible liner around an inner surface of the pool, wherein the one or more connectors configured to support one or more pool attachments.

* * * * *